US009381634B2

(12) United States Patent
Schiestl et al.

(10) Patent No.: US 9,381,634 B2
(45) Date of Patent: Jul. 5, 2016

(54) FASTENER DRIVING TOOL

(75) Inventors: Ulrich Schiestl, Hohenems (AT); Peter Roth, Grabs (CH)

(73) Assignee: HILTI AKTIENGESELLSCHAFT, Schaan (LI)

( * ) Notice: Subject to any disclaimer, the term of this patent is extended or adjusted under 35 U.S.C. 154(b) by 606 days.

(21) Appl. No.: 13/302,528

(22) Filed: Nov. 22, 2011

(65) Prior Publication Data

US 2012/0132691 A1 May 31, 2012

(30) Foreign Application Priority Data

Nov. 25, 2010 (DE) ..... 10 2010 061 938

(51) Int. Cl.
*B25C 1/08* (2006.01)

(52) U.S. Cl.
CPC ..... *B25C 1/08* (2013.01)

(58) Field of Classification Search
CPC ..... B25C 1/14; B25C 1/08
USPC ..... 227/9, 10, 130
See application file for complete search history.

(56) References Cited

U.S. PATENT DOCUMENTS

| | | | | |
|---|---|---|---|---|
| 5,000,128 | A * | 3/1991 | Veldman | 123/46 SC |
| 5,213,247 | A * | 5/1993 | Gschwend et al. | 227/10 |
| 6,974,063 | B2 * | 12/2005 | Schiestl et al. | 227/9 |
| 6,988,469 | B2 * | 1/2006 | Schiestl et al. | 123/46 SC |
| 7,004,366 | B2 * | 2/2006 | Schiestl et al. | 227/8 |
| 7,134,585 | B2 * | 11/2006 | Schiestl et al. | 227/9 |
| 7,152,584 | B2 * | 12/2006 | Odoni et al. | 123/460 |
| 8,544,710 | B2 * | 10/2013 | Tanaka | 227/10 |
| 9,027,816 | B2 * | 5/2015 | Dittrich | B25C 1/08 227/10 |
| 2004/0134960 | A1 | 7/2004 | Schiestl et al. | |
| 2004/0251296 | A1 * | 12/2004 | Schiestl et al. | 227/10 |
| 2006/0032886 | A1 * | 2/2006 | Gschwend et al. | 227/10 |
| 2009/0184148 | A1 * | 7/2009 | Dittrich et al. | 227/9 |
| 2009/0250499 | A1 * | 10/2009 | Hahn et al. | 227/10 |
| 2010/0230461 | A1 * | 9/2010 | Tanaka | 227/9 |

FOREIGN PATENT DOCUMENTS

| | | | |
|---|---|---|---|
| DE | 10260702 | A1 | 7/2004 |
| DE | 103 26 473 | B3 | 12/2004 |
| JP | 60-91652 | U | 6/1985 |
| JP | 3121856 | U | 10/2006 |

OTHER PUBLICATIONS

German Search Report, Application No. 10 2010 061 938.8, dated May 8, 2012.
Partial Translation Office Action Counterpart Japanese App. No. 2011-255131, mailed Jun. 17, 2015.

* cited by examiner

*Primary Examiner* — Andrew M Tecco
(74) *Attorney, Agent, or Firm* — Jeremy Jay

(57) ABSTRACT

The invention relates to a fastener driving tool comprising a tank (2) for storing a fluid, in particular liquefied petroleum gas, a combustion chamber (1) connected to the tank (2), wherein the combustion chamber (1) has a movable piston (6) for powering a driving plunger (7), and a metering device (4) arranged between the tank (2) and the combustion chamber (1), wherein the metering device (4) has a movable displacement member (19) for ejecting the fuel out of a metering space (15), wherein the displacement member (19) can be moved by an actuation force from a first power source in a displacement direction against a pressure of the fuel, wherein an additional supporting force from a second power source acts on the displacement member (19).

6 Claims, 1 Drawing Sheet

FASTENER DRIVING TOOL

The invention relates to a fastener driving tool, more particularly a hand-held fastener driving tool.

DE 102 60 702 A1 describes a fastener driving tool with a metering device for controlled supply of a fuel, wherein the metering device comprises a chamber with a movable piston therein. Depending on the embodiment, the piston can be operated mechanically, being moved by contact pressure on the fastener driving tool, or by an electrical drive unit.

The problem of the invention is to specify a fuel-operated fastener driving tool that has a particularly effective metering device for the fuel.

This problem is solved for a fastener driving tool of the type mentioned above in accordance with the invention. The actual actuating force for metering the fuel or for an ejection of the fuel from the metering device can be kept considerably smaller because of the support force from a second power source that acts on the displacement member. This is generally advantageous, regardless of the precise manner in which the displacement member is driven. Within the meaning of the invention, the first power source for actuating the displacement member can be any controlled drive force such as the muscular force of the operator, an electrical actuator, a pneumatic actuator or the like.

In a particularly preferred embodiment of the invention, the first power source can be the muscular force of an operator. This is preferably, but not necessarily, provided in the course of a process of pressing the fastener driving tool against a workpiece. For example, a movable pressing member connected to additional safety precautions of the fastener driving device can be coupled via a mechanical link to the displacement member.

In a particularly preferred embodiment of the invention, the displacement member is subjected to the pressure of the fuel as a support force on a side facing away from the metering space. Due to the consequent subjection of the displacement member to a pressure of the fuel on both sides, the forces acting on the displacement member due to the fuel pressure cancel one another out at least to some extent, so that the force required for moving the displacement member toward the metering space is reduced. In a preferred detailed design, the displacement member is subjected to a pressure to generate the support force in an opposing space separated from the metering space by a valve member. In the interest of a simple mechanical solution, the displacement member can also be preferably constructed as a linearly movable piston, wherein a cross section of the piston projecting into the opposing space is preferably, but not necessarily, smaller than a cross section of the piston projecting into the metering space. Depending on requirements, however, the displacement member can also be connected on at least one of its two sides to a diaphragm closing off the metering space or the opposing space, or can be connected in some other known manner, as is described for example in the prior art document DE 102 60 702 A1. In principle, this also includes solutions in which the metering space is itself variable, for example, by formation as a diaphragm, a bellows or the like. A displacement member within the meaning of the invention is understood to be at least one movable component for driving the change of volume.

Alternatively or additionally, a support spring can be arranged on the displacement member. Depending on the design, such a support spring can be the sole source of the support force, so that only the differential force between the support force of the spring and the force exerted by the fuel is necessary for actuating the displacement member. However, the spring can also be arranged in order to allow a fine adjustment of the force and/or to bring the displacement member into a defined position, depending on the operating state. For example, an adjustability of the necessary first force source can be provided by being able to adjust the support force by means of a change of a stop for the spring. In particular, the support spring can also act in an opening direction of the displacement member if the additional forces such as the pressure forces of the fuel in the metering space and an opposing space are configured accordingly.

A fastener driving tool according to the invention can be particularly advantageously actuated by a muscular force of the operator, with the metering and the injection of the fuel from the metering space into the combustion chamber also being accomplished by the muscular force. In principle, a fastener driving tool according to the invention is also advantageous in combination with an electrically operated metering device, however, since the consumption of electric power for operating the metering device is reduced by the second support force or the considerable reduction of the actuation force.

Further advantages and characteristics of the invention follow from the embodiment example described below as well as the dependent claims.

An embodiment of the invention will be described below and explained in detail with reference to the attached drawings.

Figure 1:
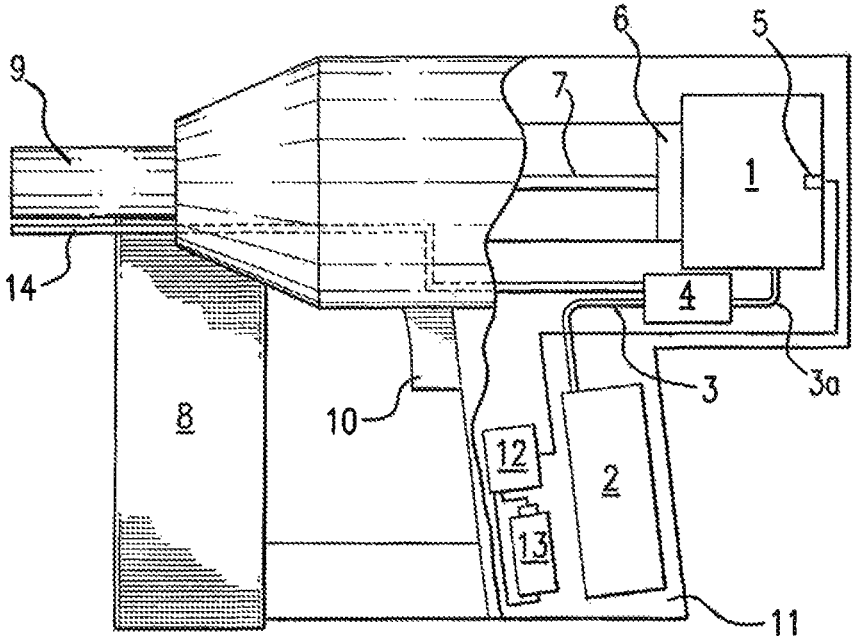
FIG. 1 shows a schematic overall view of a fastener driving tool according to the invention.

The fastener driving tool in FIG. 1 comprises a combustion chamber 1 into which a fuel, liquid petroleum gas in the present example, can be introduced in a controlled manner from a fuel tank 2 by means of lines 3 via a metering device 4. By igniting a fuel-air mixture in the combustion chamber 1 by means of a spark plug 5, a piston 6 with a connected driving plunger 7 is driven forward in order to drive a fastening element from a magazine 8 into a workpiece (not shown).

An outlet member 9 that must be initially pressed against the workpiece for safety reasons, for which the muscular force of the operator is used, is provided in an anterior area of the fastener driving tool. Ignition of the fastener driving tool is accomplished in the present case by means of an actuation switch 10 that is arranged on a handle area 11 of the tool. In addition to the fuel tank 2, a control electronics unit 12 with an electrical energy storage means 13, a battery in the present case, is located in the handle 11. These electrical devices are used primarily to ignite the fuel. In an alternative preferred embodiment, in which no electrical storage means is provided in the tool, this task can also be performed by an electromechanical ignition such as a piezo-switch or the like.

The metering device 4, in which an incoming fuel line 3 and an outgoing fuel line 3*a* open into the metering device 4, is only shown schematically in FIG. 1. A mechanical contact pressure member 14, which is constructed as a linkage 14 shown only schematically and which terminates at one end in the area of the outlet member 9, is also connected to the metering device 4. Thereby the metering device 4 is actuated synchronously with a pressing of the fastener driving tool against the workpiece, or an actuation of the contact pressure member 14.

Figure 2:
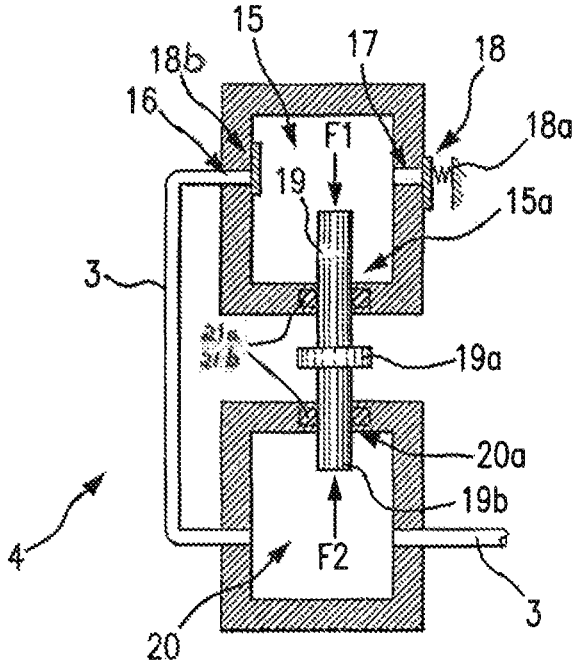
FIG. 2 shows a schematic view of the metering tool from FIG. 1.

The metering device 4 is shown in a schematic detail view in FIG. 2. It comprises a metering space 15 that has a fuel inlet 16 and a fuel outlet 17. The inlets and outlets 17 can each be closed off with reverse-operating valve members 18 in the manner of check valves. An entry opening 15*a*, into which a displacement member 19 constructed as a cylindrical piston is inserted, is also provided in the metering space 15. An annular seal 21*a* seals the displacement member 19 against the wall of the opening 15*a*.

If liquid petroleum gas as the fuel then flows into the metering space 15 via the check valve 18*b*, a force tending to expel the displacement member 19 from the metering space 15 acts on the piston-shaped displacement member 19, which force corresponds to the product of the pressure present in the metering space 15 and the cross section of the opening 15*a* or the relevant cross section of the displacement member 19.

In order to eject liquid petroleum gas from the metering space 15 via the outlet opening 17, it is provided in accordance with the functioning of the metering device 4 that the displacement member 19 is moved into the metering space 15 in order to displace a corresponding amount of liquid petroleum gas, specifically liquid petroleum gas in the liquid phase.

The drive force for this movement is provided in the present case by the muscular force of the operator as a first power source exerted via the contact pressure member or linkage 14 onto the displacement member 19. For this purpose, a corresponding schematically shown molding 19*a* for connection with the linkage 14 is provided on the displacement member 19.

In order to reduce the necessary actuating force, which requires correspondingly large mechanical work against the pressure in the metering space 15, a second power source is provided according to the invention that exerts a support force, directed in a movement direction into the metering space 15, onto the displacement member 19.

In the present example, this support force is provided by guiding an end 19*b* of the displacement member 19 facing away from the end projecting into the metering space 15 into an opposing space 20. Similarly to the metering space 15, the opposing space 20 has an opening 20*a* into which the end 19*b* of the displacement member 19 is inserted and which is sealed off against the displacement member 19 by means of an annular seal 21*b*.

A fuel line 3 leads both into and out of the opposing space 20, the exiting part of the fuel line 3 being connected to the inlet 16 of the metering space 15.

The opposing space 20 is therefore subject to the pressure of the fuel tank 2. Accordingly, a support force F2 opposed to the force F1 driving the displacement member 19 out of the metering space 15 is exerted onto the end of 19*b* of the displacement member 19. The support force F2 corresponds to the product of the pressure prevailing in the opposing space 20 and the cross-sectional area of the opening 20*a* of the opposing space 20.

Since no additional elements such as springs exert forces onto the displacement member 19 in the illustrated case, it is provided that the cross section of the opening 20*a* of the opposing space 20 is somewhat smaller than the cross section of the opening 15*a* of the metering space 15. Thereby the displacement member 19 is pressed in the direction of the opposing space 20 with a relatively small differential force Fl-F2 when fuel pressure is present in both volumes 15, 20.

The invention operates as follows:

In an actuation-free state of the metering device 4, liquid petroleum gas flows out of the fuel tank 2 via the line 3 and the opposing space 20 into the metering space 15 until the latter is maximally filled. The force Fl is somewhat greater than the force F2, so the displacement member 19 is pressed out of the metering space 15 by the fuel pressure up to an optionally adjustable stop.

If the fastener driving tool is then pressed against the workpiece by the muscular force of the operator as the first power source, the linkage 14 is moved, whereby the displacement member 19 is moved into the metering space 15 by means of the mechanical coupling, not shown. The thereby induced pressure increase or displacement of the liquid fuel in the metering space 15 leads to the opening of the outflow-side valve member 18 against a compression spring 18*a*, so that the liquid petroleum gas flows through the further extent of the line 3*a* into the combustion chamber 1.

The valve 18*b* arranged on the inlet side of the metering space is loaded in the closing direction, so that only the well-defined amount of liquid petroleum gas displaced by the displacement member 19 due to its insertion into the metering space 15 flows into the combustion chamber. As soon as the displacement member 19 has moved completely into the metering space 15, the compression spring 18*a* closes the valve member 18 and the metering process is finished.

Then an ignition spark from the spark plug 5 is triggered by actuating the switch 10 and the fuel-air mixture in the combustion chamber 1 is ignited in the familiar manner.

The invention claimed is:

1. A fastener driving tool, comprising:

a tank for storing a fuel, a combustion chamber connected to the tank, wherein the combustion chamber has a movable piston for powering a driving plunger, and a metering device arranged between the tank and the combustion chamber, wherein the metering device has a movable displacement member for ejecting the fuel out of a metering space, wherein the displacement member can be moved by an actuation force from a first power source in a displacement direction, into the metering space, against a pressure of the fuel in the metering space, and, wherein the displacement member comprises a side face facing away from the metering space, wherein the side face is subjected to a pressure of the fuel in the tank as a second power source provides an additional supporting force that acts on the displacement member and is directed into the metering space.

2. The fastener driving tool according to claim 1, wherein the first power source is provided by the muscular force of an operator while pressing the driving tool against a workpiece.

3. The fastener driving tool according to claim 2, wherein the pressure for generating the additional supporting force is applied onto the displacement member in an opposing space separable from the metering space by a valve member.

4. The fastener driving tool according to claim 3, wherein the displacement member is a linearly movable piston, and wherein a cross section of the piston projecting into the opposing space is smaller than a cross section projecting into the metering space.

5. The fastener driving tool according to claim 1, wherein the pressure for generating the additional supporting force is applied onto the displacement member in an opposing space separable from the metering space by a valve member.

6. The fastener driving tool according to claim 5, wherein the displacement member is a linearly movable piston, and wherein a cross section of the piston projecting into the opposing space is smaller than a cross section projecting into the metering space.

* * * * *